United States Patent [19]

Takegawa et al.

[11] Patent Number: 4,465,761

[45] Date of Patent: Aug. 14, 1984

[54] IMAGE-FORMING PHOTOSENSITIVE COMPOSITION

[75] Inventors: Yukio Takegawa; Akira Tukada; Susumu Suzuka; Nobuyoshi Endo, all of Tokyo, Japan

[73] Assignees: Oriental Photo Industries Co., Ltd.; Hodogaya Chemical Co., Ltd., both of Tokyo,

[21] Appl. No.: 351,379

[22] Filed: Feb. 23, 1982

Related U.S. Application Data

[63] Continuation of Ser. No. 187,898, Sep. 17, 1980, abandoned.

[30] Foreign Application Priority Data

Sep. 27, 1979 [JP] Japan ..... 54-123138
Oct. 31, 1979 [JP] Japan ..... 54-139772

[51] Int. Cl.[3] ..... G03C 1/52

[52] U.S. Cl. ..... 430/341; 430/343; 430/344; 430/345

[58] Field of Search ..... 430/343, 344, 345, 341, 430/338, 340

[56] References Cited

U.S. PATENT DOCUMENTS

| | | | |
|---|---|---|---|
| 3,322,542 | 5/1967 | Ullman et al. | 430/338 |
| 3,490,907 | 1/1970 | Schenk et al. | 430/343 |
| 3,637,390 | 1/1972 | Peterson | 430/344 |
| 3,980,480 | 9/1976 | Laridon et al. | 430/344 |
| 3,986,880 | 10/1976 | Wainer et al. | 430/344 |
| 4,097,288 | 6/1978 | Lawton | 430/345 |

*Primary Examiner*—Won H. Louie, Jr.
*Attorney, Agent, or Firm*—Flynn, Thiel, Boutell & Tanis

[57] ABSTRACT

An image-forming photosensitive composition comprises:

(a) an organohalogen compound capable of forming a free radical by the irradiation with light,
(b) a substantially colorless dye which colors when it is contacted with an acidic substance,
(c) an aromatic amine and/or conjugated nitrogen-containing heterocyclic compound,
(d) a binder, and
(e) an aliphatic amine and/or alicyclic amine.

15 Claims, No Drawings

IMAGE-FORMING PHOTOSENSITIVE COMPOSITION

This is a continuation, of application Ser. No. 187,898, filed Sept. 17, 1980, abandoned.

BACKGROUND OF THE INVENTION

1. Field of the Invention

The present invention relates to an image-forming photosensitive composition which is to be irradiated with light directly to print out a colored image and then heated to obtain a fixed image.

As compared with known, similar image-forming photosensitive compositions, the image-forming photosensitive composition of the present invention has a reduced fog density in the non-image part and an improved $\gamma$ value advantageously.

2. Description of Prior Art

It has been well known that a photosensitive composition comprising a combination of a substantially colorless dye which colors when it comes into contact with an acidic substance, used for the pressure-sensitive recording paper or the like, and organohalogen compound capable of forming a free radical by light irradiation forms a colored image by the light irradiation. This fact has been disclosed in, for example, the specifications of Japanese Patent Publications Nos. 24,188/1963, 14404/1964, 17701/1964 cations Nos. 24,188/1963, 14404/1964, 17701/1964 (corresponding to U.S. Pat. No. 3,082,086) and 204/1974 and Japanese patent application Laid-Open (Kokai) Nos. 9227/1974, 126,228/1975 and 73,133/1978. However, the known image-forming sensitive compositions disclosed in the above specifications have demerits such that the fog density is high in the nonimage part, only a low $\gamma$ value is available and a soft image is obtained.

SUMMARY OF THE INVENTION

After intensive investigations made for the purpose of overcoming the above demerits, the inventors have found a photosensitive composition comprising (a) an organohalogen compound capable of forming a free radical by the light irradiation, (b) a substantially colorless dye which colors in contact with an acidic substance, (c) an aromatic amine and/or conjugated nitrogen-containing heterocyclic compound, (d) a binder, and (e) an aliphatic amine and/or alicyclic amine. The photosensitive composition of the present invention will be explained below more in detail.

The organohalogen compounds (a) capable of forming a free radical by the irradiation with light are defined as below. In the below-mentioned formulae, an aryl, especially phenyl and naphthyl, and heterocyclic residues may be substituted, preferably by $C_1$–$C_4$ alkyl, $C_1$–$C_4$ alkoxy, nitro or halogen.

(i) Compounds of the formula:

$$R—CX_3$$

wherein R is an aryl group, an alkyl group, allyl, an aroyl group, an alkenyl group, hydrogen, a halogen atom or a heterocyclic residue, preferably phenyl or naphthyl which may be substituted, $C_1$–$C_4$ alkyl, $C_2$–$C_6$ alkenyl, hydrogen, Br, Cl, or a specific heterocyclic group such as benzoxazole, benzothiazole, benzoimidazole, pyridine and quinaldine; and X is a halogen atom. There are used, for example, carbon tetrabromide, iodoform, hexachloroethane, 2,2,2-tribromoethanol, p-nitrobenzotrichloride, benzotribromide, $\alpha,\alpha,\alpha,\alpha',\alpha',\alpha'$-hexachloroxylene, dichlorobromomethane, 2-$\omega,\omega,\omega$-trichloromethyl-6-nitrobenzothiazole, $\omega,\omega,\omega$-tribromoquinaldine and 4-$\omega,\omega,\omega$-tribromomethylpyridine.

(iii) Compounds of the formula:

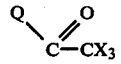

wherein Q is an amino group, an alkylamino group, an aralkylamino group, an arylamino group, an aryl group or allyl, preferably amino, $C_1$–$C_6$ alkylamino, phenyl, benzyl, naphthylamino, phenylamino or naphthyl; and X is a halogen atom. There are used for example trichloroacetamide, N-ethyl-tribromoacetamide, p-nitro-$\alpha,\alpha,\alpha$-tribromoacetophenone and $\alpha,\alpha,\alpha$-trichloroacetophenone.

(iii) Compounds of the formula:

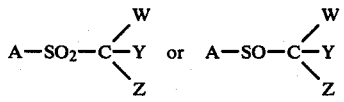

wherein W, Y and Z each are hydrogen, chlorine or bromine but all of them are not hydrogens at the same time, A is an aryl group, an alkyl group, allyl, a heterocyclic residue or

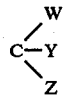

group in which W, Y and Z have the same meanings as above, preferably $C_1$–$C_4$ alkyl, phenyl, naphthyl, $C_2$–$C_6$ alkenyl or the specific heterocyclic group as defined in the above "R". There are used for example, pentabromodimethylsulfoxide, hexabromodimethylsulfone, trichloromethyl-phenylsulfone, hexachlorodimethylsulfone, 2-tribromomethylsulfonyl-6-methoxybenzothiazole, 1-methyl-2-tribromomethylsulfonylbenzoimidazole and 2-tribromomethylsulfonyl-5-nitrobenzothiazole.

The substantially colorless dyes (b) used as a coloring matter which develop color when they come in contact with an acidic substance include, for example, phthalide dyes such as 3,3-bis(4'-dimethylaminophenyl)-6-dimethylaminophthalide and 3-(4'-dimethylaminophenyl)-3-(1',2'-dimethylindole-3'-yl)-phthalide; xanthene dyes such as 3-diethylamino-7-dibenzylaminofluoran and 3-diethylaminobenzo(c)-fluoran; phenothiazine dyes such as 3,6-di(dimethylamino)-N-benzoylphenothiazine; lactam dyes such as 3-dimethylamino-6-methoxyfluoran-$\gamma$-4'-nitroanilinolactam and 3-diethylamino-6-butoxyfluoran-$\gamma$-phenyl hydrazinolactam; leuco-Auramine dyes such as N-bis-(4'-dimethylaminophenyl)-methyl-2,5-dichloroaniline; spiropyran dyes such as 1,3,3-trimethylindolino-benzospiropyran and 7-diethylamino-3'-phenyl-2,2'-spirobi(2H-1-benzopyran); methane base dyes such as bis-(p-dimethylaminophenyl)-phenylmethane; and carbinol dyes such as bis-(p-dimethylaminophenyl)phenylmethanol.

The aromatic amine or conjugated nitrogen-containing heterocyclic compound (c) to be used as a sensitizer or storage stability-improving agent is defined as below. In the formulae, (i), (ii) and (iii), an aryl, especially phenyl and naphthyl, and heterocyclic residues may be substituted, preferably by $C_1$–$C_4$ alkyl, $C_1$–$C_4$ alkoxy, nitro or halogen.

(i) Compounds of the formula:

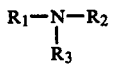

wherein $R_1$ is a substituted or unsubstituted phenyl group, α-naphthyl group or β-naphthyl group, and $R_2$ and $R_3$ each are hydrogen, an alkyl group, an aryl group, allyl or an aralkyl group preferably phenyl, naphthyl, benzyl, H, $C_1$–$C_6$ alkyl or $C_2$–$C_6$ alkenyl. There are used for example diphenylamine, p-toluidine, p-chloroaniline, N,N-dibenzylaniline, N-ethylaniline, N-phenyl-α-naphthylamine, N-phenyl-β-naphthylamine, triphenylamine, N,N'-diphenyl-p-phenylenediamine and N-ethyldiphenylamine.

(ii) Compounds of the formula:

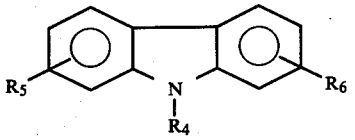

wherein $R_4$ is hydrogen, an alkyl group, an alkenyl group, an aralkyl group or an aryl group, preferably H, $C_1$–$C_4$ alkyl, $C_2$–$C_6$ alkenyl, benzyl, phenyl or naphthyl; and $R_5$ and $R_6$ each are hydrogen, an alkyl group, an alkoxy group, a halogen atom or a dialkylamino group, preferably H, $C_1$–$C_2$ alkyl, $C_1$–$C_4$ alkoxy, Cl, Br, or dialkyl ($C_1$–$C_4$) amino. There are used for example, carbazole, N-ethylcarbazole, N-methylcarbazole, N-benzylcarbazole, N-vinylcarbazole, 3,6-dibromocarbazole, 3-dimethylamino-N-ethylcarbazole and 3,6-dimethoxy-N-methylcarbazole.

(iii) Compound of the formula:

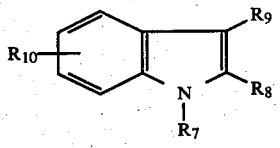

wherein $R_7$ is hydrogen, an alkyl group, an aralkyl group or an aryl group, preferably H, $C_1$–$C_4$ alkyl, benzyl or phenyl; and $R_8$, $R_9$ and $R_{10}$ each are hydrogen, an alkyl group, an alkoxy group, a halogen atom, a dialkylamino group or an aryl group, preferably H, $C_1$–$C_2$ alkyl, $C_1$–$C_4$ alkoxy, Cl, Br, dialkyl ($C_1$–$C_4$)amino or phenyl. There are used for example, indole, 2-phenylindole, 2-methylindole, 1,2-dimethylindole, 1-phenylindole, 4-chloro-2-methylindole, 5-methylindole, 5-ethoxyindole, 5-methoxy-1-ethyl-2-methylindole and diindolyl.

(iv) Other conjugated heterocyclic compounds such as oxazoles, e.g. the oxazole per se, 2,5-diphenyloxazole and 2-aminobenzoxazole; thiazoles, e.g. the thiazole per se, 2,5-dimethylbenzothiazole and 2-amino-benzothiazole; imidazoles, e.g. the imidazole per se, 2-phenylimidazole and benzoimidazole; pyrazoles, e.g. the pyrazole per se and 1-phenylpyrazole; pyrazolones, e.g. 3-methyl-5-pyrazolone and 1-phenyl-3-methyl-5-pyrazolone; pyrroles, e.g. the pyrrole per se, dipyrryl and 2-phenylpyrrole; quinolines, e.g. 2,4-dimethylquinoline and 2,6-dimethylquinoline; indolizines, e.g. 2-phenylindolizine and 2-methylindolizine; triazoles, e.g. benzotriazole and 1,2,4-triazole; acridine, o-phenanthroline, 1,5-naphthylidine, phenoxazine, pyridazine, cinnoline, phthalazine, 2,3-dimethylquinoxaline and phenazine.

As binder (d), there may be mentioned high molecular compounds such as polystyrene, ethylcellulose polyvinyl acetate, polyvinylidene chloride, polymethyl methacrylate, butyral resin, polycarbonate, vinyl chloride/vinyl acetate copolymer resin and styrene/butadiene copolymer resin.

As the aliphatic amine and alicyclic amine (e) to be used for the purpose of reducing fog density in the non-image part and improving γ value, the following compounds may be used:

(i) Aliphatic amines, preferably containing 1 to 22 carbon atoms, which may be substituted and/or cyclic.

Primary alkylamines such as butylamine, pentylamine, hexylamine, octylamine, nonylamine, dodecylamine, tetradecylamine, octadecylamine, pentadecylamine, eicosylamine and docosyl amine; secondary alkylamines such as dibutylamine, and didodecylamine, tertiary alkylamines such as tributylamines and trioctylamine; benzylamine, dibenzylamine, tribenzylamine, cyclohexylamine, ethanolamine, diethanolamine, triethanolamine, ethylenediamine, diaminobutane, diaminohexane, diaminooctane, diaminododecyl and diaminododecane; and (ii) Alicyclic amines:

Piperidine, piperazine, 4-aminopiperazine and morpholine.

Among the amines (e), those having a dissociation constant pKa of higher than 7.5 are preferably used. The amines having a pKa of higher than 9.0 are particularly preferred. In the specification, all references to part are based on weight.

In carrying out the process of the present invention, the image-forming photosensitive composition can be prepared easily by dissolving 1.0–3.0 parts of an organohalogen compound (a), 1.0–5.0 parts of a coloring agent (b), 0.5–3.0 parts of an aromatic amine and/or conjugated nitrogen-containing heterocyclic compound (c) and 5.0–8.0 parts of a binder (d) and 0.02–0.7 part of an aliphatic amine and/or alicyclic amine (e) in 100 parts of an organic solvent while using a safety lamp. If necessary, 0.5–3.0 parts of a ferrocene compound may be added thereto as a sensitizer. As preferred organic solvents, there may be mentioned, for example, benzene, toluene, xylene, tetrahydrofuran, acetone, methylethylketone, cyclohexanone, acrylonitrile, methanol, ethanol, methyl cellosolve, ethyl cellosolve, ethyl acetate and dioxane. Further, a mixture thereof is also used. The above solution may comprises 0.5 to 5.0 parts by weight of (a), 0.5 to 10.0 parts by weight of (b), 0.2 to 10.0 parts by weight of (c), 1.0 to 15.0 parts by weight of (d) and 0.1 to 2.0 parts by weight of (e).

Photosensitive sheets can be prepared easily with the image-forming photosensitive composition of the present invention by applying the photosensitive liquid to a base such as paper, baryta paper, synthetic paper or synthetic resin film according to rotary application method, roll coater method or blade coater method while using a safety lamp.

According to the invention, it is preferable that a substrate on which the photosensitive composition is coated has an under coating. The under coating should be inserted between a substrate such as paper and the photosensitive composition layer. When the under coat layer is provided on a substrate, the photosensitive composition comprising ingredients (a), (b) and (d) alone can provide advantages mentioned as above. Of course, the under coat layer is very effective to the photosensitive composition comprising (a), (b), (c), (d) and (e).

The under coat layer is adopted to control an optical density change to 0.06 or below when a coating composition comprising the above ingredients (b) and (d) has been applied to the surface of the substrate.

The term "optical density change" herein indicates a value obtained by deducting a reflection optical density of a paper substrate determined in the same manner as shown below from a reflection optical density of a coating, obtained by applying the image-forming composition comprising components (b) and (d), but free of component (a), to a paper base so that an amount of the component (b) may be 0.003 mole/$m^2$ under irradiation with a light (preferably less than 500 Lx.), drying the same and measuring the reflection optical density immediately thereafter with Mcbeth densitometer RD 519.

If a paper having an undercoating layer of an optical density change of above 0.06 is used as the base, the resulting image has a high fog level and, in addition, a raw photosensitive material having this paper as the base will cause an increase in the fog during the storage impractically.

The undercoat layer used in the present invention contains preferably a filler and a film-forming agent and the surface has desirably no electron-accepting property. More concretely, the undercoat layer can be prepared by selecting the filler and film-forming agent from substances having no electron-accepting property, suitably determining the mixing ratio of the filler to the film-forming agent in the undercoating agent and forming the surface with a film-forming agent having no electron-accepting property so that the filler is not contained on the surface of the undercoat layer. In the present invention, however, electron-accepting substances and other additives such as dispersing agent, coating assistant, anti-foaming agent, antistatic agent and deterioration-preventing agent may be incorporated in the composition in such an amount that the optical density change does not exceed 0.06. Further, coloring components such as dyes may also be incorporated therein for obtaining a colored (other than white) background.

The filler in the undercoat layer according to the present invention may be selected from the group consisting of mineral white powders known as white pigments or extender pigments. More concretely, there may be mentioned preferably substances having no electron-accepting property such as gypsum, barium sulfate, calcium carbonate, magnesium carbonate and zinc oxide. In addition, electron-accepting substances such as clay, talc, asbestine, asbestos, satin white, titanium oxide, diatomaceous earth and lithopone may also be used in such an amount that the optical density change is kept below 0.06. It is undesirable, however, that those electron-accepting substances are exposed in a considerable amount on the surface of the undercoat layer as described above with reference to the art papers and coated papers. The filler is not always necessary, however, when the base paper per se to which the undercoat layer is to be applied has satisfactory opacity and whiteness. The undercoat layer may comprise only the film-forming agent capable of controlling the optical density change to below 0.06.

As the film-forming agents usable for the undercoat layer of the present invention, there may be mentioned natural high molecular substances such as starch, casein, gelatin and sodium alginate as well as modified products of them and synthetic latexes such as styrene-butadiene and acrylonitrile-butadiene. Film-forming agents mainly comprising polymers or copolymers having carboxyl group as monomer unit known as electron-accepting substances (such as polyacrylic acid, styrene-maleic acid, acrylonitrile-methacrylic acid and styrenebutadiene-acrylic acid), resins having phenolic hydroxyl group (such as phenol formalin resin) are not preferred. However, according to the present invention, those electron-accepting film-forming agents can be incorporated, if necessary, in the composition in a small amount with which the optical density change is not increased to above 0.06.

The ratio of the film-forming agent to the filler used for the undercoat layer according to the present invention is such that amount of the film-forming agent is 10–100 wt.%, based on the undercoat layer, and that of the filler is 90–0 wt.%. Suitable amount of the undercoat layer is 1–30 g/$m^2$.

The undercoat layer according to the present invention may be either single layer or a laminate comprising two or more layers.

Coating methods for forming the undercoat layer may be selected from various methods over a broad range. As the methods, there may be mentioned generally bar coating method, air knife coating method, blade coating method, gravure coating method, slide hopper coating method, curtain coating method, smooth finishing method with a spar calender and cast coating method.

The following examples further illustrate the present invention, which by no means limit the scope of the present invention. In the examples and referential examples, parts are given by weight, unless otherwise stated. Image density and fog density were measured with Mcbeth reflection density meter RD-519 or Mcbeth penetrameter TD-504.

EXAMPLE 1

2.9 Parts of 3,3-bis-(4'-dimethylaminophenyl)-6-dimethylaminophthalide, 2.0 parts of carbon tetrabromide, 2.1 parts of 2-phenylindole, 6.9 parts of polystyrene and 0.4 part of octadecylamine (pKa=10.60) were dissolved in a solvent mixture comprising 71.5 parts of toluene and 16.6 parts of methyl vinyl ketone to obtain a photosensitive solution. The solution was then applied to an NK Hi-coat paper (a product of Nihon Kako Seishi Kabushiki Kaisha) at a rate of 36 g/$m^2$ (corresponding to that in the dry state of 5.0 g/$m^2$) and dried to obtain an image-forming photosensitive paper. The photosensitive paper was closely contacted with a step tablet (a product of Kodak Co.), exposed to a light of vacuum printing frame (20 W chemical lamp P-113-B; a product of Dai-Nihon Screen Seizo Kabushiki Kaisha) for 3 minutes and fixed by heating at 110° C. with a hot air drier for 2 minutes to obtain a blue image. The resulting image density was measured. Quantities of light exposure E (lux sec.) (converted to—log E) were plotted as abscissae and densities were plotted as ordinates to obtain a characteristic curve of the photosensitive paper from which value $\gamma$ was determined.

For reference, the same photosensitive solution as in Example 1 except that octadecylamine was omitted was prepared and treated in the same manner as in Example 1 to obtain a blue image (Referential example 1). The above results are summarized in Table 1.

TABLE 1

| Example (Referential Example) | Hue of the image | Reflection density of the image | Fog density | value $\gamma$ |
|---|---|---|---|---|
| 1 | Blue | 1.25 | 0.10 | 1.0 |
| (1) | Blue | 1.30 | 0.25 | 0.56 |

From the above results, the effects obtained by the addition of octadecylamine of the present invention are apparent.

EXAMPLE 2

A photosensitive solution comprising the same components as in Example 1 and 2.0 parts of ferrocene was treated in the same manner as in Example 1 under the irradiation with a red safety lamp to obtain a clear blue image.

For reference, the same photosensitive solution as in Example 2 but excluding octadecylamine was prepared and treated in the same manner as in Example 1 to obtain a blue image (Referential Example 2). The results are summarized in Table 2.

TABLE 2

| Example (Referential Example) | Hue of the image | Reflection density of the image | Fog density | value $\gamma$ |
|---|---|---|---|---|
| 2 | Blue | 1.45 | 0.10 | 1.50 |
| (2) | Blue | 1.50 | 0.19 | 0.89 |

From the above results, the effects obtained by the addition of octadecylamine are apparent.

EXAMPLE 3

3.5 Parts of 3-diethylamino-benzo-(c)-fluoran, 3.3 parts of carbon tetrabromide, 1.0 part of 2-phenylimidazole, 0.45 part of pentylamine (pKa=10.66) and 10.0 parts of polystyrene were dissolved in a solvent mixture comprising 130 parts of xylene and 20 parts of methyl ethyl ketone. The resulting photosensitive solution was applied to a polyester film base and treated in the same manner as in Example 1 to obtain a purplish red image.

For reference, the same photosensitive solution as in Example 3 but free of pentylamine was prepared and treated in the same manner as in Example 3 to obtain a purplish red image (Referential Example 3). The results are shown in Table 3.

TABLE 3

| Example (Referential Example) | Hue of the image | Transmittance density of the image | Fog density | Value $\gamma$ |
|---|---|---|---|---|
| 3 | Purplish-red | 1.52 | 0.04 | 2.50 |
| (3) | Purplish-red | 1.55 | 0.06 | 1.40 |

From the above results, the effects obtained by the addition of pentylamine are apparent.

EXAMPLE 4

4.7 Parts of 3,3-bis-(1,2-dimethylindoyl-3-yl)-6-dimethylaminophthalide, 4.0 parts of iodoform, 4.0 parts of N-ethylcarbazole, dodecylamine (pKa=10.63) and 7.0 parts of butyral resin (S-LEC BM-2; a product of Sekisui Kagaku Kabushiki Kaisha) were dissolved in 150 parts of tetrahydrofuran to obtain a photosensitive solution. After the same treatment as in Example 1, a red image was obtained.

For reference, the same photosensitive solution as in Example 4 but free of dodecylamine was prepared and treated in the same manner as in Example 4 to obtain a red image (Referential Example 4). The results are shown in Table 4.

TABLE 4

| Example (Referential Example) | Hue of the image | Reflection density of the image | Fog density | Value $\gamma$ |
|---|---|---|---|---|
| 4 | Red | 1.56 | 0.10 | 2.2 |
| (4) | Red | 1.58 | 0.22 | 1.1 |

From the above results, the effects obtained by the addition of dodecylamine are apparent.

EXAMPLES 5–15

The same procedure as in Example 1 was reported using photosensitive solutions having compositions shown in Table 5 to obtain clear, colored images. The results are shown in Table 6. For reference, the same photosensitive solutions as in Table 5 but free of the amine compounds of pKa of higher than 7.5 were prepared and treated in the same manner as above. The results are also shown in parentheses in Table 6.

TABLE 5

| Example | Coloring agent (parts) | Developer (parts) | Binder (parts) | Sensitizer: Amines (parts) | Sensitizer: Ferrocene compounds (parts) | Amine compounds having a pKa of higher than 7.5 (parts) | Solvent (parts) |
|---|---|---|---|---|---|---|---|
| 5 | 3-Diethylamino-7-dibenzylamino-fluoran (5.2) | Tribromoacetamide (2.8) | Vinyl chloride-vinyl acetate copolymer resin (9.0) | p-chloroaniline (2.0) | — | Dioctylamine (0.5) | Toluene (100) Dioxane (50) |
| 6 | | Carbon tetrabromide (3.3) | Cellulose acetate butylate (10.0) | 2,4-Dichloro-quinoline (2.0) | 1,1' Dimethyl-ferrocene (2.1) | Didodecylamine (0.45) | Xylene (120) Acetone (30) |
| 7 | 1,3,3-Trimethyl-indolino-7'- | Iodoform (4.0) | Polymethyl methacrylate | 1,2-Dimethyl-indole | — | Tridecylamine (0.4) | Tetrahydrofuran (150) |

TABLE 5-continued

| Example | Coloring agent (parts) | Developer (parts) | Binder (parts) | Sensitizer: Amines (parts) | Sensitizer: Ferrocene compounds (parts) | Amine compounds having a pKa of higher than 7.5 (parts) | Solvent (parts) |
|---|---|---|---|---|---|---|---|
| | dimethylaminobenzospiropyran | | (10.0) | (2.5) | | | |
| 8 | (3.5) | Tribromomethylphenylsulfone (5.0) | Butyral resin (8.0) | N—ethylcarbazole (2.0) | 1,1'-di-m-butylferrocene (2.0) | Benzylamine (0.35) | Cyclohexanone (150) |
| 9 | 3,6-Dimethoxyfluoran (3.6) | Trichloroacetamide (1.5) | Polystyrene (10.0) | 2-Phenylpyrrole (2.2) | Ferrocene ethanoe (2.0) | Cyclohexylamine (0.5) | Toluene (120) Acetone (30) |
| 10 | | Hexabromodimethylsulfoxide (3.5) | Cellulose acetate (10.0) | 2,5-Diphenyloxazole (2.0) | — | Triethanolamine (0.5) | Benzene (120) Acetone (30) |
| 11 | 3-Diethylamino-5,8-dimethylfluoran (4.2) | α,α,α-tribromoacetophenone (2.0) | Vinyl chloride-vinyl acetate copolymer resin (8.0) | 2-Methylindole (3.0) | — | 1,8-Diaminooctane (0.2) | Xylene (100) Methyl cellosolve (50) |
| 12 | | N—methyltrichloroacetamide (3.5) | Cellulose acetate (10.0) | O—Phenanthroline (2.0) | — | Piperidine (0.3) | Toluene (100) Acetone (50) |
| 13 | Bis(p-dimethylaminophenyl)-phenylmethane (3.3) | Pentabromodimethyl sulfoxide (4.0) | Polystyrene (10.0) | Diphenylamine (2.0) | — | Piperazine (0.3) | Methyl cellosolve (120) Methyl ethyl ketone (30) |
| 14 | | (2-methyl-4-chlorophenyl) trichloromethyl sulfone (3.8) | Polyvinylidene chloride (8.0) | 2-Phenylindolizine (0.8) | — | Nonylamine (0.4) | Benzene (120) Acetone (30) |
| 15 | 3,3-bis(4-dimethylaminophenyl)-6-dimethylaminophthalide (3.2) 3-diethylaminobenzo(C)-fluoran (0.7) 7-diethylamino-3'-phenyl-2,2'-spirobi-(2H—1-benzopyran) (0.7) | Carbon tetrabromide (3.3) | Polystyrene (11.0) | 2-phenylindole (3.3) | — | Stearylamine (0.4) | Toluene (120) Acetone (30) |

TABLE 6

| Example | Hue of the image | Reflection density of the image | Fog density | Value γ |
|---|---|---|---|---|
| 5 | Green | 1.53 (1.56) | 0.10 (0.17) | 2.30 (1.74) |
| 6 | " | 1.74 (1.77) | 0.10 (0.15) | 2.53 (1.94) |
| 7 | Purplish red | 2.00 (2.10) | 0.11 (0.29) | 2.70 (1.85) |
| 8 | Purplish red | 2.08 (2.13) | 0.11 (0.36) | 2.72 (1.84) |
| 9 | Yellow | 0.42 (0.46) | 0.08 (0.13) | 1.45 (0.95) |
| 10 | " | 0.51 (0.52) | 0.08 (0.13) | 1.60 (0.93) |
| 11 | Red | 1.78 (1.87) | 0.08 (0.15) | 1.63 (1.03) |
| 12 | " | 1.53 (1.57) | 0.08 (0.16) | 1.59 (0.97) |
| 13 | Green | 1.15 (1.18) | 0.09 (0.18) | 1.54 (0.84) |
| 14 | " | 0.90 (0.94) | 0.09 (0.20) | 1.32 (0.76) |
| 15 | Purplish | 2.00 | 0.08 | 2.52 |

TABLE 6-continued

| Example | Hue of the image | Reflection density of the image | Fog density | Value γ |
|---|---|---|---|---|
| | blue | (2.13) | (0.20) | (2.10) |

EXAMPLE 16

Paper base sample 1 and comparative samples A, B, C and D were prepared as follows:

Paper Base Sample 1:

A paper of a high quality which had been size-pressed (loading agent: clay) and which had properties as will be described below was prepared. An undercoating agent prepared by a method shown below was applied to the paper in an amount of about 25 g/m$^2$ with a bar coater and then dried.

Properties of the paper of a high quality

Basis weight: 62 g/m$^2$
Thickness: 0.1008 mm

Air permeability: 12.6 seconds
Whiteness: 81.6%

Preparation of Undercoating Agent

Calcium carbonate (Hakuenka CC-trademark; a product of Shiraishi Kogyo Kabushiki Kaisha) was added to water containing a small amount of sodium silicate as dispersion assistant. The mixture was treated with a ball mill for 3 hours to obtain a filler dispersion I having a solid content of 56%.

On the other hand, casein (a product of Kanto Kagaku Kabushiki Kaisha) was swollen in water. 10 Weight %, based on casein, of 28% aqueous ammonia was added thereto and the whole was heated to a temperature of 50°–60° C. to obtain a transparent film-forming solution I having a casein content of 20%.

Then, 50 parts of film-forming agent solution I and 16 parts of styrene-butadiene latex (Hycar LX-402-trademark-; a product of Nihon Zeon Kabushiki Kaisha; solid content: about 45%) were added to 180 parts of the filler dispersion I slowly and the whole was stirred thoroughly. The mixture was diluted with 50 parts of water to control the solid content (filler+film-forming agent) to 40%. The mixing ratio of the filler to the film-forming agent was 100/17=5.88.

Comparative Sample A

A sample was prepared in the same manner as in the preparation of paper base sample 1 except that clay was used in place of calcium carbonate as filler.

Comparative Sample B

A paper of a high quality but free of the undercoat layer used when above described paper base sample 1 was prepared.

Comparative Sample C

Photographic baryta paper (a product of Mitsubishi Seishi Kabushiki Kaisha).

Comparative Sample D

NK Tokukata Art-trademark(Art Board etc.) (a product of Nihon Kako Seishi Kabushiki Kaisha).

The reflection optical densities on the surfaces of those bases were measured with Mcbeth densitometer RD-519 (trademark) to obtain the results shown in following Table 7.

Then, a coating solution having the following composition was applied in an amount of 5.0 g/m$^2$ [amount of component (b) being 1.22 g/m$^2$] (or in the dry state) to the surface of those bases under the irradiation with a light (500 lx.) and dried.

Coating Solution 3,3-Bis(4'-dimethylaminophenyl)-6-dimethylaminophthalide [component (b)]: 2.9 parts
2-Phenylindole: 2.1 parts
Polystyrene [component (c)]: 6.9 parts
Toluene: 71.5 parts
Methyl ethyl ketone: 16.6 parts The reflection optical densities of thus obtained samples were measured with Mcbeth densitometer RD-519 (tradename) to determine the optical density changes. The results are shown in following Table 7:

TABLE 7

| Test No. | Paper base sample | Reflection density of paper base | Reflection density of coating | Optical density change |
|---|---|---|---|---|
| 1 | 1 | 0.08 | 0.10 | 0.02 |
| 2 | Comparative A | 0.08 | 0.21 | 0.13 |
| 3 | Comparative B | 0.09 | 0.20 | 0.11 |
| 4 | Comparative C | 0.07 | 0.14 | 0.07 |
| 5 | Comparative D | 0.08 | 0.22 | 0.14 |

A photosensitive solution having the following composition was applied in an amount of 5.0 g/m$^2$ (as in the dry state) to the paper bases and then dried to form the image-forming materials:

Sensitive Solution 3,3-Bis-(4'-dimethylaminophenyl)-6-dimethylamino phthalide: 2.9 parts
Carbon tetrabromide: 2.0 parts
2-Phenylindole: 2.1 parts
Polystyrene: 6.9 parts
Toluene: 71.5 parts
Methyl ethyl ketone: 16.6 parts The image-forming materials were closely contacted with Kodak Step Tablet No. 2 and exposed to a light with an image using a black light luminescent lamp (FL-20 BLB-trademark-; a product of Toshiba Kabushiki Kaisha) as light source. After the heat treatment at 110° C. for 3 minutes, a blue image was obtained. The maximum density ($D_{max}$) measured with Mcbeth densitometer RD-519 and fog were as shown in following Table 8.

For examining aging stability of the image-forming materials, they were stored at 35° C. under 75% RH for 7 days and the image was formed thereafter in the same manner as above. The maximum density and fog were also measured. The results are also shown in Table 8.

TABLE 8

| Test No. | Paper base sample | Immediately after the preparation | | After storage | |
|---|---|---|---|---|---|
| | | Dmax | Fog | Dmax | Fog |
| 6 | 1 | 1.30 | 0.10 | 1.25 | 0.10 |
| 7 | Comparative A | 1.30 | 0.21 | 1.25 | 0.26 |
| 8 | Comparative B | 0.95 | 0.20 | 0.65 | 0.24 |
| 9 | Comparative C | 1.30 | 0.14 | 1.25 | 0.20 |
| 10 | Comparative D | 1.30 | 0.22 | 1.25 | 0.28 |

It is understood from Table 8 that as compared with comparative samples (Tests Nos. 7–10), the sample of the present invention (Test No. 6) had a lower fog level immediately after the preparation and, therefore, a higher image contrast value and, in addition, substantially no increase in fog was observed after the storage.

EXAMPLE 17

The mixing ratio of the filler and the film-forming agent (casein) was varied in paper base sample 1 and comparative base sample A used in above Example 16 and the same tests as in Example 16 were repeated with the paper bases. The results are shown in Table 9.

TABLE 9

| Test No. | Paper base sample: Filler | Paper base sample: Filler/film-forming agent (mixing ratio) | Optical density change | Immediately after the preparation: Dmax | Immediately after the preparation: Fog | After storage: Dmax | After storage: Fog |
|---|---|---|---|---|---|---|---|
| 11 | Calcium carbonate | 2.94 | 0.02 | 1.30 | 0.10 | 1.25 | 0.10 |
| 12 | Calcium carbonate | 1.76 | 0.02 | 1.30 | 0.10 | 1.25 | 0.10 |
| 13 | Clay | 2.94 | 0.05 | 1.30 | 0.13 | 1.25 | 0.15 |
| 14 | " | 1.76 | 0.03 | 1.30 | 0.11 | 1.25 | 0.11 |

It is understood from Table 9 that the optical density change can be reduced not only in case of using calcium carbonate as filler but also in case of using clay as filler with which preferred results cannot be obtained in Example 16 by increasing the relative amount of the film-forming agent in the composition comprising clay/film-forming agent (casein). Particularly, by controlling the optical density change to below 0.06, fog of the image-forming material containing the same as the base can be controlled on a low level directly after the preparation or after the storage.

Degrees of the surface exposure of the filler in the undercoat layer could be recognized qualitatively by comparison by means of an electron microscope of scanning type.

The embodiments of the invention in which an exclusive property or privilege is claimed are defined as follows:

1. An image-forming photosensitive composition consisting essentially of:

(a) 1.0 to 3.0 parts by weight of an organohalogen compound capable of forming a free radical by irradiation with light, (b) 1.0 to 5.0 parts by weight of a substantially colorless dye which colors when it is contacted with an acidic substance, said dye being selected from the group consisting of phthalide dyes, xanthene dyes, phenothiazine dyes, lactam dyes and spiropyran dyes, (c) 0.5 to 3.0 parts by weight of an aromatic amine and/or conjugated nitrogen-containing heterocyclic compound effective as a sensitizer or storage stability improving agent, (d) 5.0 to 8.0 parts by weight of a binder, and (e) 0.02 to 0.7 part by weight of an aliphatic amine, alicyclic amine and/or saturated heterocyclic amine effective to reduce the fog density on the non-image area and to improve the λ value.

2. A composition as claimed in claim 1, in which said aliphatic amine (e) contains 1 to 22 carbon atoms.

3. A composition as claimed in claim 1, in which said aliphatic amine is selected from the group consisting of butylamine, pentylamine, hexylamine, octylamine, nonylamine, dodecylamine, tetradecylamine, octadecylamine, pentadecylamine, eicosylamine, docosylamine, didodecylamine, tributylamine, trioctylamine, ethanolamine, diethanolamine, triethanolamine, ethylenediamine, diaminobutane, diaminohexane, diaminooctane, diaminododecyl and diaminododecane; said alicyclic amine is cyclohexylamine and said saturated heterocyclic amine is selected from the group consisting of piperadine, piperazine, 4-aminopiperazine and morpholine.

4. A composition as claimed in claim 1, in which said aliphatic amine and alicyclic amine have a dissociation constant of higher than 7.5.

5. A composition as claimed in claim 1, which further contains a ferrocene compound.

6. A photosensitive coating solution which comprises ingredients (a), (b), (c), (d) and (e) defined in claim 1 and a solvent.

7. A photosensitive sheet in which the photosensitive composition defined in claim 1 is coated on a substrate.

8. A photosensitive sheet as claimed in claim 7, which has an under coat layer between said substrate and said composition.

9. A composition as claimed in claim 1 in which said dye (b) is 3,3-bis(4'-dimethylaminophenyl)-6-dimethylaminophthalide or 3-(4'-dimethylaminophenyl)-3-(1',2'-dimethylindole-3'-yl)phthalide.

10. A composition as claimed in claim 1 in which said dye (b) is a phthalide compound.

11. A composition as claimed in claim 1 in which (a) is $CBR_4$, (b) is 3,3-bis-(4'-dimethylaminophenyl)-6-dimethylaminophthalide and (c) is 2-phenylindole.

12. A composition as claimed in claim 1 in which said dye (b) is a xanthene dye.

13. A composition as claimed in claim 1 in which said dye (b) is selected from the group consisting of 3-diethylamino-7-dibenzylamino-fluoran and 3-diethylamino-benzo-(c)-fluoran.

14. A composition as claimed in claim 1 in which said dye (b) is a spiropyran dye.

15. A composition as claimed in claim 1 in which said dye (b) is selected from the group consisting of 1,3,3-trimethylindolinobenzospiropyran and 7-diethylamino-3'-phenyl-2,2'-spirobi(2H-1-benzopyran).

* * * * *